United States Patent [19]

Norman

[11] Patent Number: 4,872,150

[45] Date of Patent: Oct. 3, 1989

[54] BINARY SYMBOLS FOR NUMBERS

[76] Inventor: Murry A. Norman, 164 Arthur Street, Auckland, New Zealand

[21] Appl. No.: 124,858

[22] Filed: Nov. 30, 1987

Related U.S. Application Data

[63] Continuation of Ser. No. 895,781, Aug. 12, 1986, abandoned.

[30] Foreign Application Priority Data

Sep. 9, 1985 [NZ] New Zealand ..... 213405

[51] Int. Cl.[4] ..... G04B 19/08

[52] U.S. Cl. ..... 368/223; 368/242; 368/239

[58] Field of Search ..... 434/189; 368/223–242

[56] References Cited

U.S. PATENT DOCUMENTS

| | | | |
|---|---|---|---|
| 3,677,549 | 7/1972 | Moscovich | 434/189 |
| 3,744,235 | 7/1973 | Kratomi | 368/234 |
| 3,750,384 | 8/1973 | Miller et al. | 368/82 |
| 3,919,835 | 11/1975 | Kashio | 58/50 R |
| 3,943,288 | 3/1976 | Reed et al. | 368/13 |
| 3,992,875 | 11/1976 | Kashio | 58/50 R |
| 4,618,265 | 10/1986 | Wadowski | 368/155 |

FOREIGN PATENT DOCUMENTS

| | | |
|---|---|---|
| 53-77493 | 8/1978 | Japan . |
| 57-53685 | 3/1982 | Japan . |
| 57-211092 | 12/1982 | Japan . |

OTHER PUBLICATIONS

"Binary Clock", Osburne Wireless World, vol. 6, (1980), No. 1535, Sussex, pp. 65, 66, Aug. 1980.

*Primary Examiner*—Bernard Roskoski

*Attorney, Agent, or Firm*—Young & Thompson

[57] ABSTRACT

Apparatus is disclosed for assistance in learning binary number notation. Various examples of the apparatus are disclosed, each example comprising symbols each of which can be switched between two states in which it is respectively visible and invisible. Further, each symbol is oriented differently to the other symbols or alternatively the apparatus is provided with other insignia which enables each symbol to be distinguished from the others without reference to the others. Similar apparatus with symbols other than visible symbols is suggested.

2 Claims, 6 Drawing Sheets

BINARY SYMBOLS FOR NUMBERS

This is a continuation of application Ser. No. 895,781, filed 8/12/86 now abandoned.

FIELD OF THE INVENTION

This invention relates to binary symbols for numbers and has particular but not necessarily exclusive application to symbols for time-related numbers i.e. numbers providing a measure of time. Such numbers include the time of day, the day of the week, the day of the month, the month of the year, the season of the year and the year itself.

The development of electronic computers has brought to prominence the binary system of expressing numbers. The nature of the binary system is well understood by those skilled in the art and will not be discussed in detail here. The binary system has, however, not yet come into wide use for displaying numbers. One reason for this is probably that the general public lacks familiarity with the binary system.

It is one object of the invention to provided novel apparatus related to binary means for representing numbers in a notation. By this means it is hoped to bring about a greater familiarity with binary notation.

The applicant is aware of an apparatus for demonstrating binary notation and comprising a series of lights disposed in a line and evenly spaced apart. Selected ones of the lights can be switched on or off and the series thus made to correspond to a selected binary number. However, the lights are meaningful only as a group; i.e. with reference one to the other. Any one of the lights perceived by itself is indistinguishable from the others and has no meaning by itself.

SUMMARY OF THE INVENTION

According to the invention there is provided apparatus for representing numbers in a notation related to binary, the apparatus comprising least at two elements, each element being capable of taking two alternative forms which can be perceived by one of the human senses as different one from the other, means for changing each element from one form to the other, and a carrier on which the elements are located, the apparatus including a feature enabling each element to be identified without reference to the other element or elements.

In one form of the invention, the elements are located in different orientations on the carrier. In an alternative form of the invention, the shape of each element is substantially different from that of the other elements.

According to an important aspect of the invention the apparatus comprises two groups of three elements each of which elements is capable of taking two alternative forms which can be perceived by one of the human senses as different one from the other, means for changing each element from one form to the other, and a carrier on which the elements are located, the elements being oriented on the carrier so that when all of the elements in a group are in the one form, together they make up a triangle, each element forming a side of the triangle.

In another aspect of the invention, the apparatus comprises at least two groups of elements each of which elements is capable of taking two alternative forms which can be perceived by one of the human senses as different one from the other, means for changing each element from one form to the other, and a carrier on which the elements are located, the elements in each group being generally similar to one another but different to those in the other group or groups, an indicium being provided on the carrier for enabling each element in a group to be identified without reference to the other element or elements in the group.

According to yet another aspect of the invention the apparatus comprises a clock and means responsive to signals from the clock to switch the elements in each group between the alternative forms thereby to cause the elements in the group to provide a measure of time.

BRIEF DESCRIPTION OF THE DRAWINGS

The invention is further discussed with reference to the accompanying illustrations, in which.

DETAILED DESCRIPTION OF VARIOUS EMBODIMENTS

Figure 1:
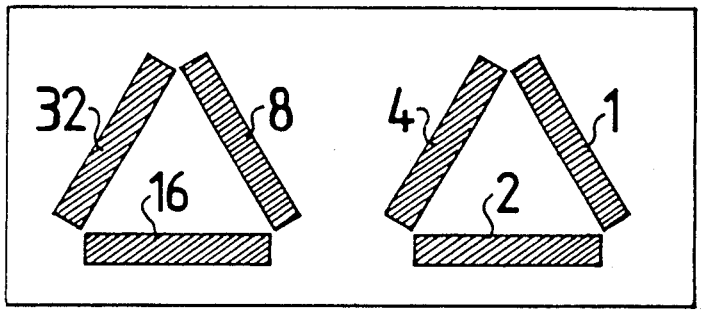
FIG. 1 shows two groups of three symbols, each group forming what is seen as a triangle.
Figure 2:
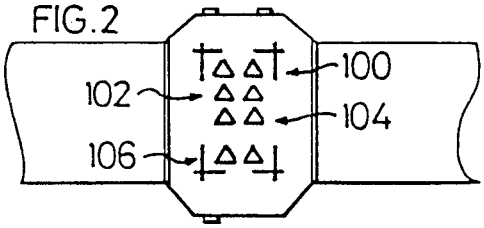
FIG. 2 is a somewhat schematic view of the face of a watch incorporating groups of the symbols shown in FIG. 1

Referring first to FIG. 1 there are shown two groups of three symbols labelled 1, 2 and 4 (in the first or right hand group) and 8, 16 and 32 (in the second or left hand group). The symbols represent in the present case two groups of three LCD (liquid crystal display) elements, the element in each group being arranged in the pattern of equilateral triangle. However, the symbols could represent the widest variety of alternative elements such as florescent light tubes or rib-like protuberances in a flat surface. Whatever form the elements take they should have the characteristic that they must be able to take two forms which can be distinguished one from another by one of the human senses. Thus in the case of LCDs, in the energised form each element can be seen but when not energised it cannot be seen. Other visible elements might, for example be a certain colour in one form and another colour in the second form. When the elements are to be perceived by the sense of touch, they might in one form be raised above the surrounding surface and in the second form be retracted flush with the surface.

It is known to provide (for example) six lights arrayed in a straight line of the purpose of demonstrating numbers in binary notation. Any light being switched 'on' represents the digit 1 in the binary notation and any light switched 'off' represents the digit 0. Thus in an array of six lights, any combination of lights switched on and off represents a number of binary. Persons who deal regularly with binary soon develop the skill to convert a binary number (whether represented as a series of 0s and 1s or, for example, lights switch on and off) to a decimal number without any need for calculation; i.e. they simply read the binary number as a decimal number. Whether the binary number is calculated or simply read it is necessary for each digit (or light) to be seen in its physical relationship to the other digits in the array otherwise it is not possible to assign a value to the digit.

In the present example, each LCD element can be seen not only as being 'on' or 'off' but also as being disposed in one of three orientations in either triangle. Thus a person who is familiar with the array shown in FIG. 1 can even though there is no other frame of reference, by its orientation, assign a value to any one of the LCD elements which is 'on' even though all the others may be 'off'.

Thus a person observing the LCD element labelled 1 switched 'on' with all the other switched 'off' will, initially by calculation and soon afterwards by rote, without the need for any other frame of reference, know that it always represents the decimal number 1. Similarly, each LCD element labelled 2, 4, 8, 16 and 32, switched 'on' with all the others 'off' will always represent the decimal numbers 2, 4, 8, 16 and 32 respectively. Moreover, groups of the elements switched 'on' can be read as other decimal numbers. In the Table 1, all permutations for switching the six LCD elements shown in FIG. 1 are shown in the centre of each column; 'on' is indicated by a black line and 'off' is indicated by a blank. At the right of each column the decimal equivalent of each permutation and at the left of each column the binary equivalent thereof is given.

Missing from the above table are the permutations of elements representing the decimal numbers 61, 62 and 63. For the purposes of the present examples, these are of no importance.

Simplified information from Table 1 is given in Table 2 in which in the right hand column the permutations of the LCD elements 1,2 and 4 making up the group in the right hand triangle are given together with the decimal value equivalent of each; and similarly in the left hand column the permutations of the elements 8, 16 and 32 are given together with the decimal value equivalents thereof. It will perhaps be somewhat clearer from Table 2 that any (decimal) number between 0 and 63 can be obtained by adding a decimal number from the left hand column to a number in the right hand column, it being assumed of course that the number 0 is represented by all of the elements in either triangle being 'off'. Any decimal number so arrived at is represented by placing together the equivalent permutation of LCDs in each column.

Figure 3:
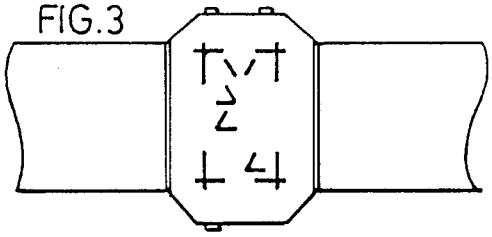
FIG. 3 is a view of the face shown in FIG. 2, with some of the symbols in the invisible state.
Figure 4:
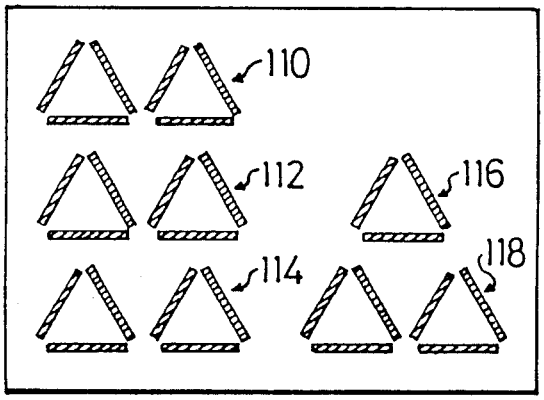
FIG. 4 is a similarly schematic view of a clock face displaying more groups of symbols.

FIG. 3 shows how four sets of arrays of the type shown in FIG. 1 can be grouped to the face of a wristwatch or clock. The upper array 100 in this example represents the hour of the day (in decimal from 0 to 24). The next array 102 represents the minute of the hour (in decimal from 0 to 59). The next array 104 represents the second of the minute (again from 0 to 59 in decimal). The lower array 106 represents the day of the month (in decimal from 1 to 31). It is necessary to provide a timing device (clock) and electronic circuitry to cause the LCD elements in the four arrays to switch on and off as appropriate. The design and construction of such circuitry (as indeed the circuitry for all the exemplary devices described herein) will be well within the capability of the skilled addressee and will not be described here.

FIG. 3 shows, by way of example, what would be seen on the watch face when the watch registers the time to be 12.24 and 48 seconds on the 6th day of the month.

Figure 5:
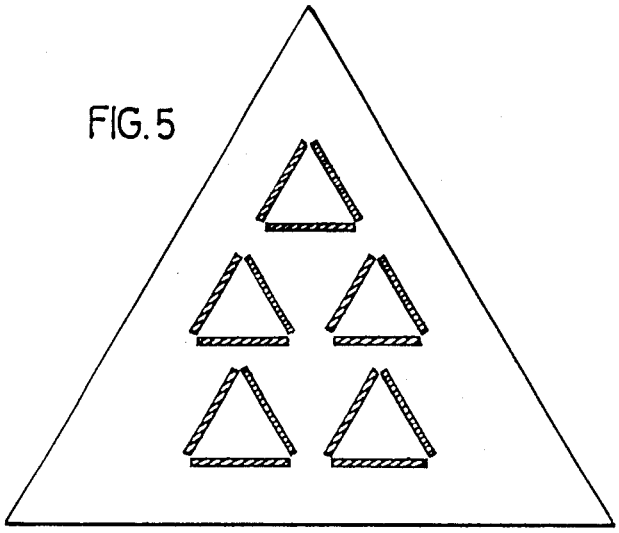
FIG. 5 is a view of a clock incorporating yet another arrangement of symbols.

In FIG. 5, a clock face is shown containing four arrays of the type illustrated in FIG. 1 and one array comprising three LCD elements only. The arrays 110, 112 and 114 on the left hand side represent respectively the hour, minute and second of the day. The array 116 on the right hand side, comprising three elements only, represents the day of the week. The reason for this is that three elements are sufficient to cover the group of numbers from 1 to 7 inclusive. The second arry 118 on the right hand side represents the day of the month.

In FIG. 5, the clock face contains an upper array for the day of the week, a middle array for the month of the year and a lower array for the day of the month.

Figure 6:
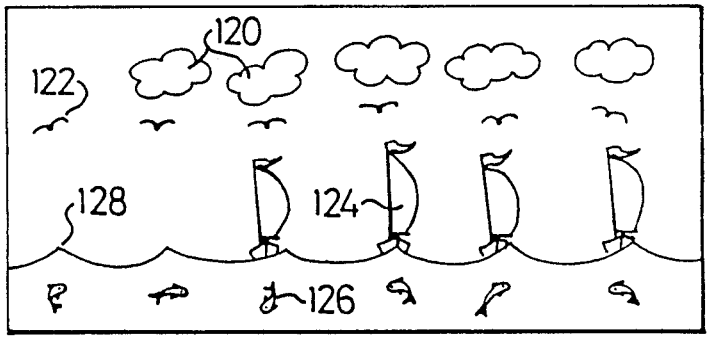
FIGS. 6 and 7, 8 to 12, 13 and 14, 15 and 16, and 17 all of which show groups of alternative symbols constituting clocks and/or calenders.
Figure 7:
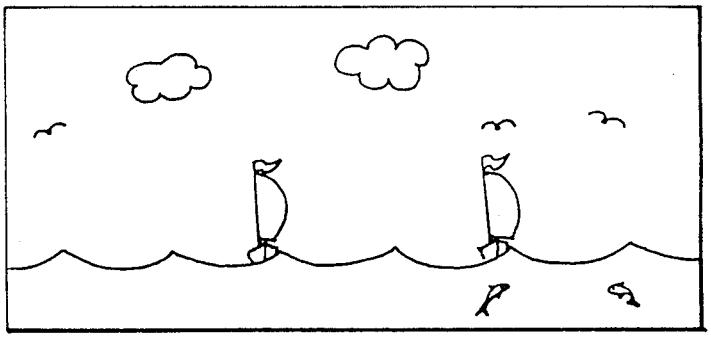

FIGS. 6 and 7 show a design for the face of a pictorial calendar clock. In this case the various elements again utilize LCDs but are shaped to represent simple objects being in the example clouds, birds, sailing boats and fishes. It will be observed that there are five clouds 120, six birds 122, four sailing boats 124 and six fishes 126. The position of the element in its row is in this case significant but since each element becomes invisible when it is 'off' thereby becoming ineffective a frame of reference or indicium. This other frame of reference is constituted by the illustration of waves. It will be noted that there are six wave crests 128. A fish is located below each crest and one sailing boat, bird and cloud are located above each crest. The waves are in permanent depiction. They may be painted on the screen forming the front of the clock or they may be in the form of an LCD element which is permanently 'on'. In any case the observer can easily judge from the waves the position of any of the elements in any of the rows. The clouds represent the day of the month, the birds represent the minute of the hour, the sailing boats represent the hour of the day and the fishes represent the second of the minute. In FIG. 6 all of the elements are shown as being 'on', a situation which would not in practice occur. It is shown by way of explanation only. FIG. 7 shows an example of a real time situation and according to the example it is thirty five minutes and three seconds past ten on the twentieth day of the month.

Figure 8:
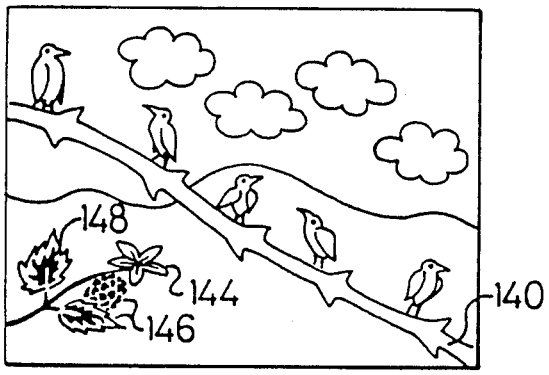

FIGS. 8 to 12 show a similar arrangement for a calendar where there are four cloud elements for the month of the year and five bird elements for the day of the month. The branch 140 with its thorns is in permanent depiction and is the frame of reference. In addition, there is a twig 142 depicted in LCD elements comprising (as can be seen in FIG. 8) a blossom 144 (used to indicate the spring), two fresh leaves with a berry 146 (used to indicate the summer), and two dried leaves 148 (for the autumn). The winter is indicated by the twig without any leaves, the blossom or the berry. The calendar is intended for use in the northern hemisphere.

Figure 9:
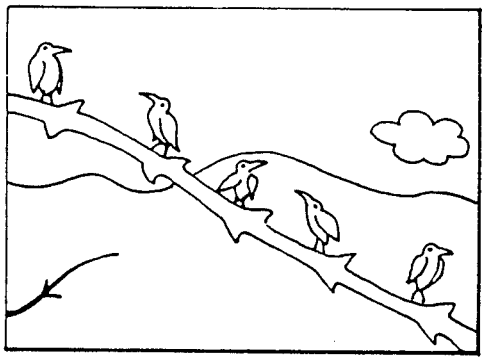
Figure 10:
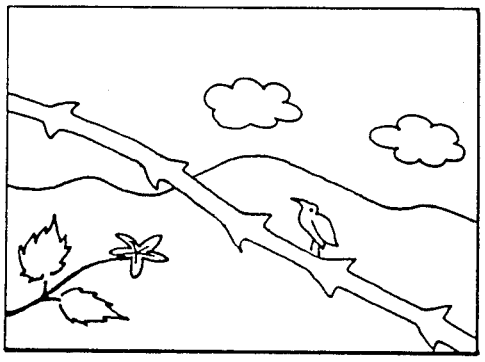
Figure 11:
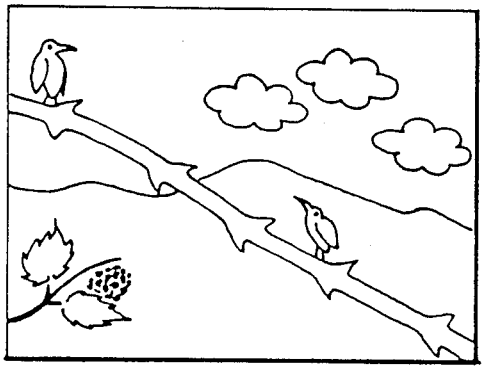
Figure 12:
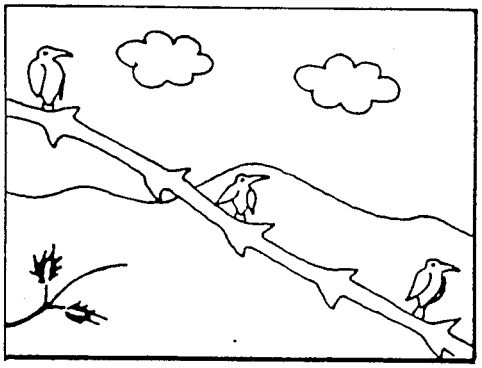

The entire set of LCD elements is shown in FIG. 8 as being 'on', a situation which would not ordinarily occur. In FIG. 9 the calendar shows that it is winter and the date is January 31. In FIG. 10, it is summer and the date is July 18. It is spring and the date is May 2 in FIG. 11; and in FIG. 12 it is October 21 in the autumn.

Figure 13:
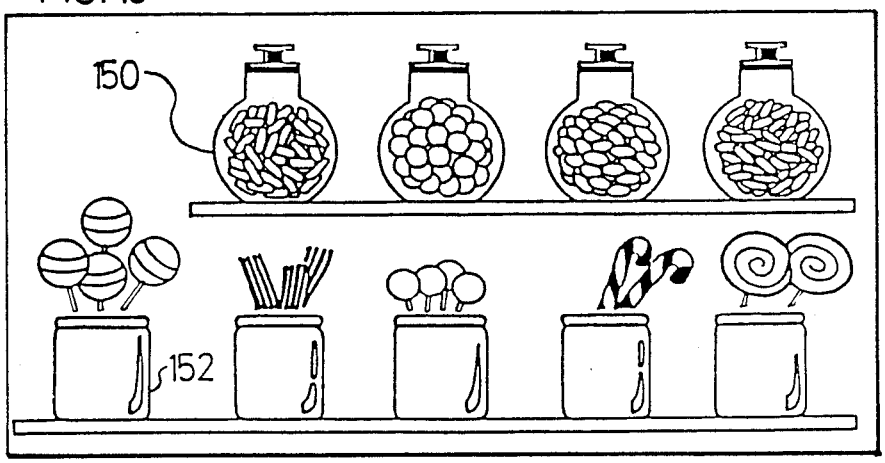
Figure 14:
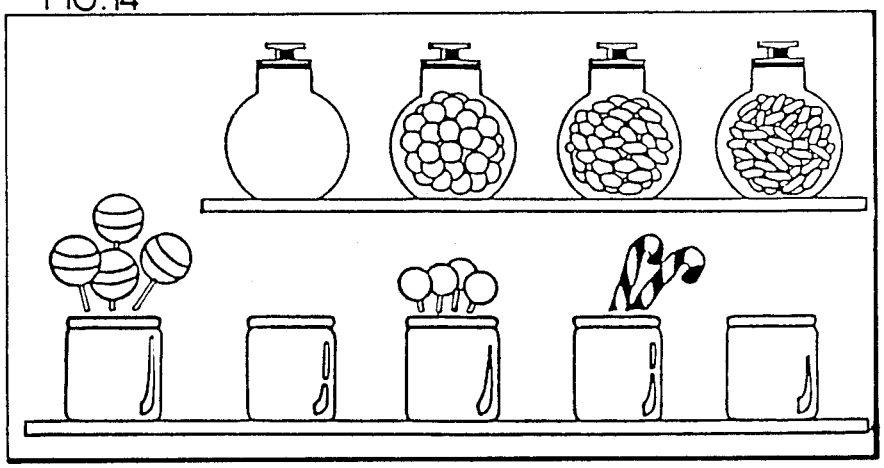

FIGS. 13 and 14 show a calendar which might appeal to a child. Here there is an upper row of four candy jars 150 and a lower row of five candy jars 152. The jars, being in permanent depiction, are the frame of reference. The LCD elements representing the candies are present or absent to indicate numbers. The upper row represents the month of the year and the lower row represents the day of the month. In FIG. 14 it is July 22.

Figure 15:
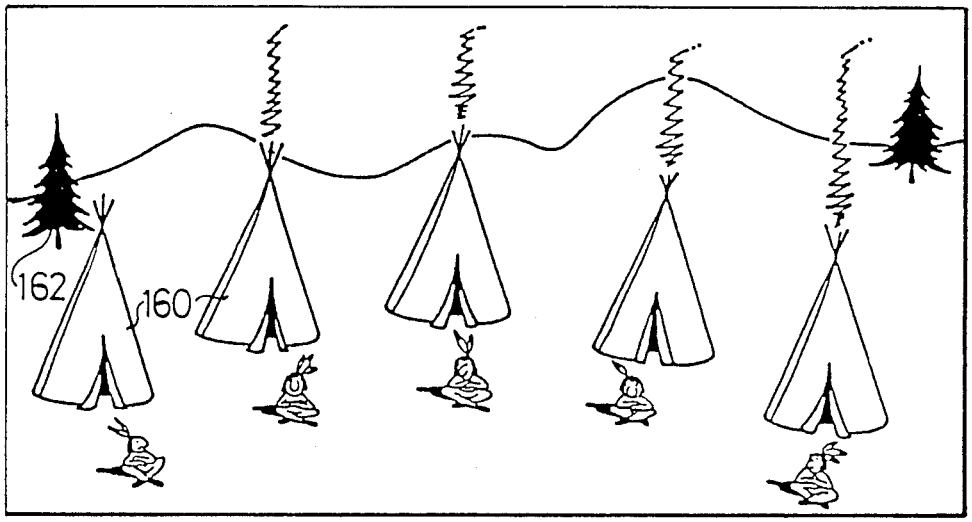
Figure 16:
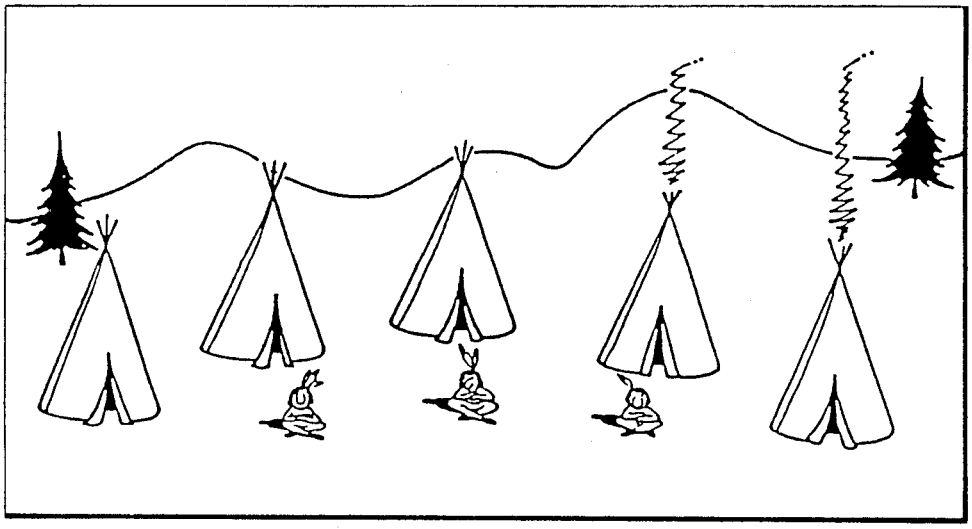

In FIGS. 15 and 16 the wigwams 160 are in permanent depiction and provide the frame of reference. The trees 162 are merely for decoration. The smoke columns indicate the month of the year and the warriors indicate the day of the month. In FIG. 16 it is March 14.

Figure 17:
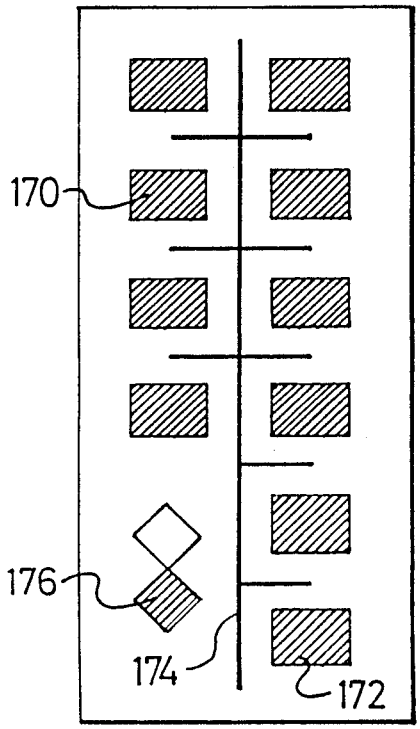

FIG. 17 depicts an alternative design for a watch face. The four LCD elements 170 in the column on the left indicate the hour of the day and the six elements 172 in the column on the right indicate the minute of the hour. The frame of reference is the thin vertical line 174 between the columns intersected by the horizontal cross lines. The diamonds 176 below the left hand column would beat out the seconds.

In yet another example, one or more arrays are provided, each array comprising a number of elements which are distinguishable one from another by their form. Consider for example an array of six elements in the form of the letters S, E, T, O, Y and A. If these letters were put together in the order given in an apparatus such as, for example, a time piece or calendar they would if they were all visible at the same time be seen as the word SETOYA. A user could soon learn furthermore that the letter A always occupies the right hand position, and so on the letter Y always occupies the second from right hand position, and so on the letter S always occupying the sixth from right hand (i.e. in fact the left hand) position. Also the user could soon learn that any group of letters seen together represents a specific number in binary and also in decimal. For example, the letters YA seen by themselves represent 000011 in binary and thus 3 in decimal; the letters EOA seen by themselves represent 010101 in binary and thus 21 in decimal; and so on. It is important that the letters in each array are different from one another. It should also be clear that it is not necessary that letters be used; the widest variety of symbols may be used as long as the symbols in any array are different from one another. Letters are however useful as any combination will come to be read as a quasi-word rather than as individual letters especially if they are carefully chosen. It is considered that the letters making up the array SETOYA are for this reason a good combination especially as when read as a word they have an attractive quality. Other examples of arrays of letters are EZOPIA, OFZLIA and UFOZLI.

Clearly more than one array would usually have to be provided for most time pieces or calendars.

Although the examples have been shown as incorporating LCD it is emphasized that the invention may be used with any alternative suitable form of elements. Light emitting diodes might be employed whether or not of the same colour; they might for example be mounted in a bracelet or a wand. As previously suggested herein, the elements might be constituted by protuberances which are mechanically arranged to stand proud, or be retracted flush with, a surface. In a very simple form, the elements might be constituted by discs or blocks manually inserted or withdrawn from holes in a box. This would be used, not for timing, but simply to learn to perceive numbers in binary notation although the holes in the box might be grouped so as to constitute a calendar. The elements could also be in the form of advertising symbols. Even jets in a fountain could be employed with selected ones thereof being turned on or off by a suitable timing mechanism.

It is furthermore envisaged that the numbers displayed by any of the elements as described could be assigned other meanings such as letters, characters, symbols and words of spoken languages or computer or other technical languages.

I claim:

1. Apparatus for conveying time and date information by way of at least one array, each array containing at least one pictorial image presented on a plane having no visible fittings, each of said pictorial images having no meaning attached to its shape but by its presence in an array indicating the integer 1 and by one of its absence and its diminishment indicating the integer 0, whereby each of said at least one arrays represents a binary number indicating at least one of seconds, minutes, hours, days of the week, days of the month, months, seasons and years, said at least one image in said at least one array being positioned relative to a reference not forming part of said at least one array and not forming part of said at least one image in said at least one array not withstanding the presence, absence or diminishment of other images in any said array.

2. Apparatus according to claim 1, wherein said at least one pictorial image is formed by at least one liquid crystal element.

* * * * *